US005781937A

United States Patent [19]

Liang

[11] Patent Number: 5,781,937

[45] Date of Patent: Jul. 21, 1998

[54] TOILET DEODORIZING SYSTEM

[76] Inventor: Ming-Feng Liang, 21, Lane 187, Chung Cheng Road Sec. 2, Jen Te, Tainan, Taiwan

[21] Appl. No.: 879,464

[22] Filed: Jun. 20, 1997

[51] Int. Cl.[6] ..... E03D 9/052

[52] U.S. Cl. ..... 4/213; 4/217

[58] Field of Search ..... 4/213, 217

[56] References Cited

U.S. PATENT DOCUMENTS 2,238,461 4/1941 Carman ..... 4/213

2,279,789 4/1942 Jentzer ..... 4/213

4,944,045 7/1990 Agelatos et al. ..... 4/213

*Primary Examiner*—Robert M. Fetsuga

*Attorney, Agent, or Firm*—Pro-Techtor International Services

[57] ABSTRACT

A toilet deodorizing system in which a motor is controlled by a micro switch on a toilet seat being hinged to a toilet bowl to turn a vane wheel in a container when a person sits on the toilet seat, causing a suction force to be induced at a dip tube for drawing spoil air from the toilet bowl into an antiseptic solution in the container for treatment.

2 Claims, 3 Drawing Sheets

TOILET DEODORIZING SYSTEM

BACKGROUND OF THE INVENTION

The present invention relates to a toilet deodorizing system which is automatically induced to draw spoil air from the bowl to an antiseptic solution in a container for treatment when a person sits on the toilet seat.

When one sits on a toilet seat of a toilet to empty one's bowels, a bad smell will be produced to spoil the air. Even if air purifier means is provided in the toilet and operated to purify the air, the toilet user will still smell the bad smell of the discharged waste matter.

SUMMARY OF THE INVENTION

The present invention has been accomplished to provide a toilet deodorizing system which eliminates the aforesaid problem. It is one object of the present invention to provide a toilet deodorizing system which draws spoil air from the toilet bowl to a container for deodorization when one sits on the toilet seat to empty the bowels. It is another object of the present invention to provide a toilet deodorizing system which is automatically activated to carry bad smell away from the toilet bowl when a person sits on the toilet seat. To achieve these and other objects of the present invention, there is provided a toilet deodorizing system which a container holding an antiseptic solution, a vane wheel suspended in the container, a motor controlled to turn the vane wheel in producing a turbulent flow of air, causing a vacuum suction force to be induced at a dip tube for drawing spoil air from the toilet bowl into the antiseptic solution in the container for treatment, and a micro switch mounted on the toilet seat at the bottom to automatically switch on the motor when a person sits on the toilet seat.

BRIEF DESCRIPTION OF THE DRAWINGS

FIG. 4 is a schematic drawing showing the toilet seat pressed down, the switch lever of the micro switch pressed on the toilet bowl, the micro switch switched on;

DETAILED DESCRIPTION OF THE PREFERRED EMBODIMENT

Figure 1:
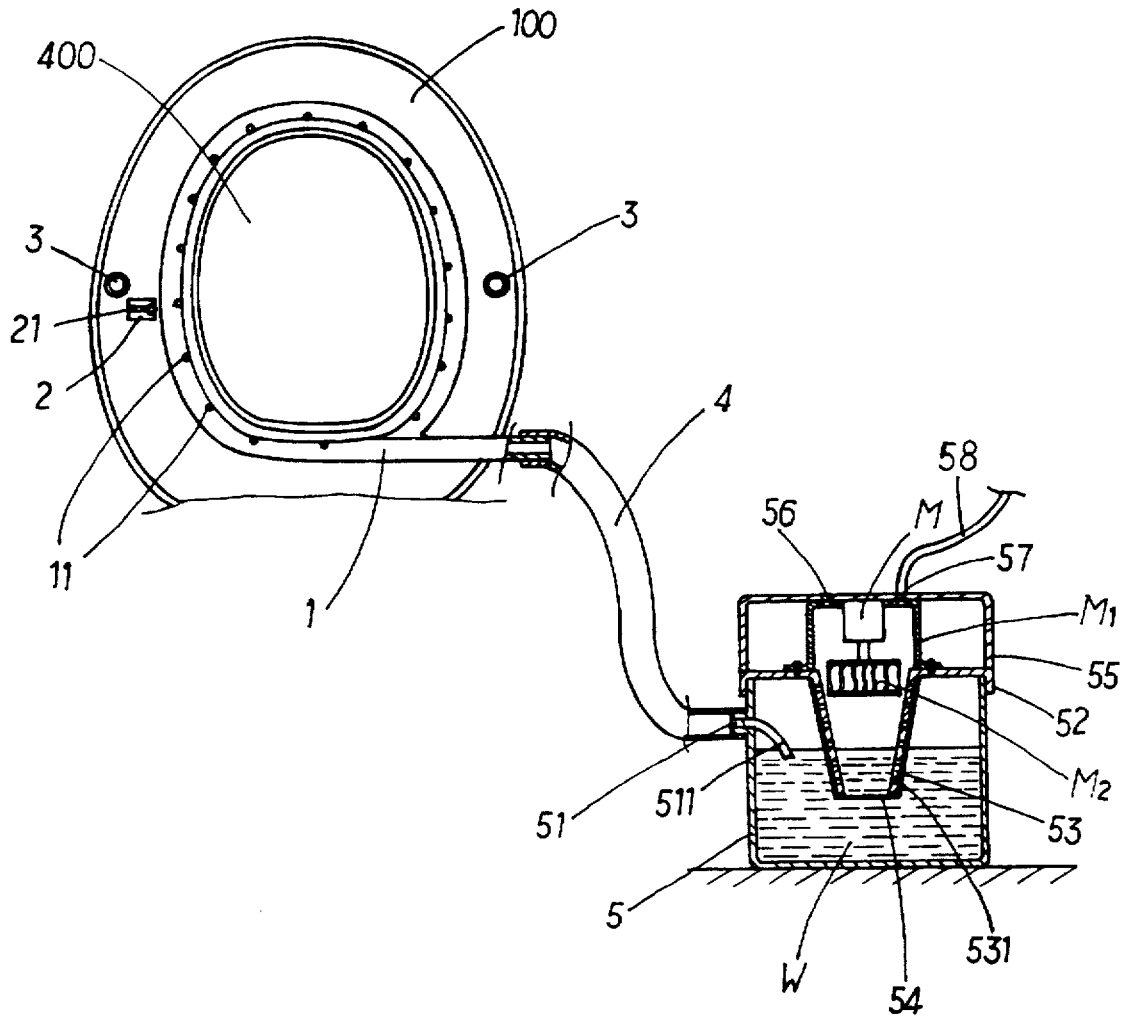
FIG. 1 shows a toilet deodorizing system according to the present invention.
Figure 2:
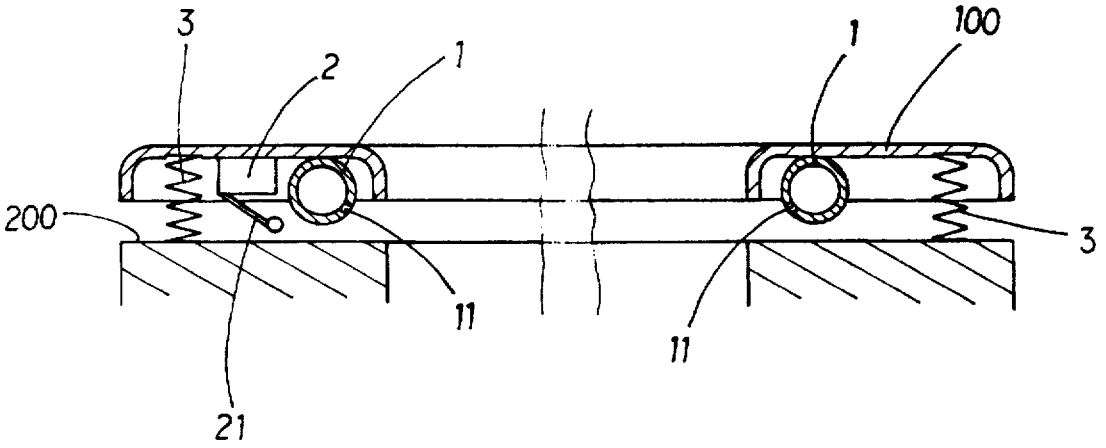
FIG. 2 is a sectional view in an enlarged scale of a part of the present invention, showing the toilet seat closed on the toilet bowl, the stainless steel springs supported on the toilet bowl, the micro switch switched off.

Referring to FIGS. 1 and 2, a toilet seat 100 is hinged to a toilet bowl 200. A rigid air intake tube 1 and a micro switch 2 mounted on the toilet seat 100 at its bottom side. The rigid air intake tube 1 has a plurality of bevel inlets 11 spaced around the center opening 400 of the toilet seat 100 and sloping downwardly inwards, two stainless steel springs 3 are bilaterally fastened to the bottom side of the toilet seat 100. When the toilet seat 100 is closed on the toilet bowl 200, the stainless steel springs 3 are supported on the top side of the toilet bowl 200 to prevent a direct contact between the switch lever 21 of the micro switch 2 and the toilet bowl 200. When the toilet seat 100 is pressed down to compress the stainless steel springs 3, the switch lever 21 of the micro switch 2 is forced into contact with the top side of the toilet bowl 200, thereby causing the micro switch 2 to be switched on. The rigid air intake tube 1 has one end connected to a container 5 through a hose 4. The micro switch 2 is connected to a motor M in the container 5 by an electric wire (not shown).

Figure 3:
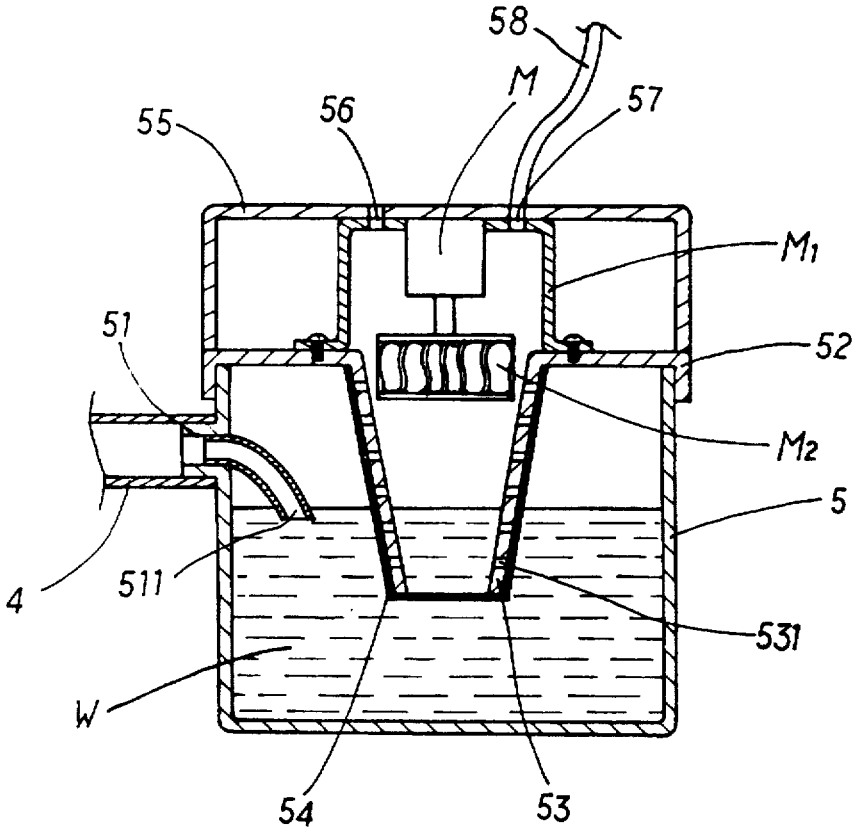
FIG. 3 is a sectional view in an, enlarged scale of a part of the present invention, showing the internal arrangement of the container and the shield.

Referring to FIG. 3 and FIG. 1 again, the container 5 is covered with a container cover 52, having a hole 51 disposed at one side near the top and connected to the hose 4, and a dip tube 511 mounted in the hole 51. The dip tube 511 has one end connected to the hole 51, and an opposite end dipped in an antiseptic solution W in the container 5. The container cover 52 has a downwardly disposed conical flange 53 at the center. The conical flange 53 has pores 531 spaced around the periphery, and is covered with a wire gauze filter 54. A shield 55 is covered on the container cover 52 of the container 5, having a motor mounting frame M1 on the inside fixedly secured to the container cover 52 of the container 5, an air inlet 56, and an air outlet 57. The air outlet 57 is connected to a toilet drain system (not shown) by an exhaust pipe 58. The aforesaid motor M is fixedly mounted inside the motor mounting frame M1. A vane wheel M2 is coupled to the motor M and suspending in the conical flange 53 of the container cover 52.

Figure 4:
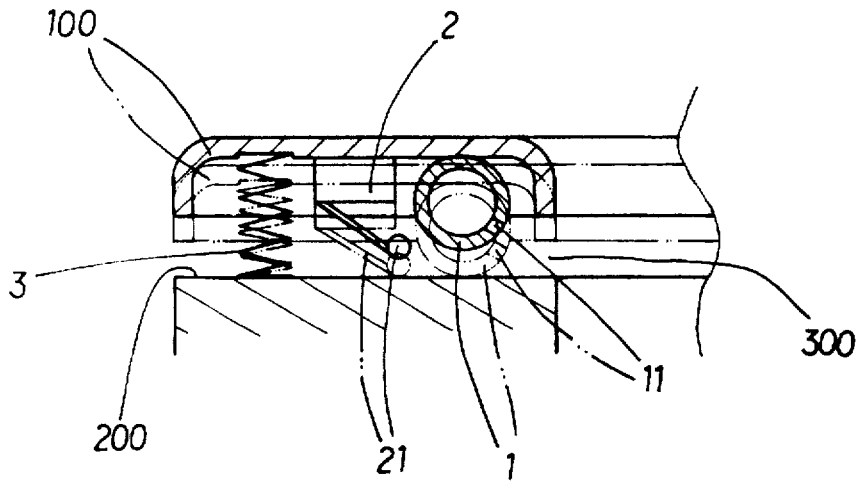
Figure 5:
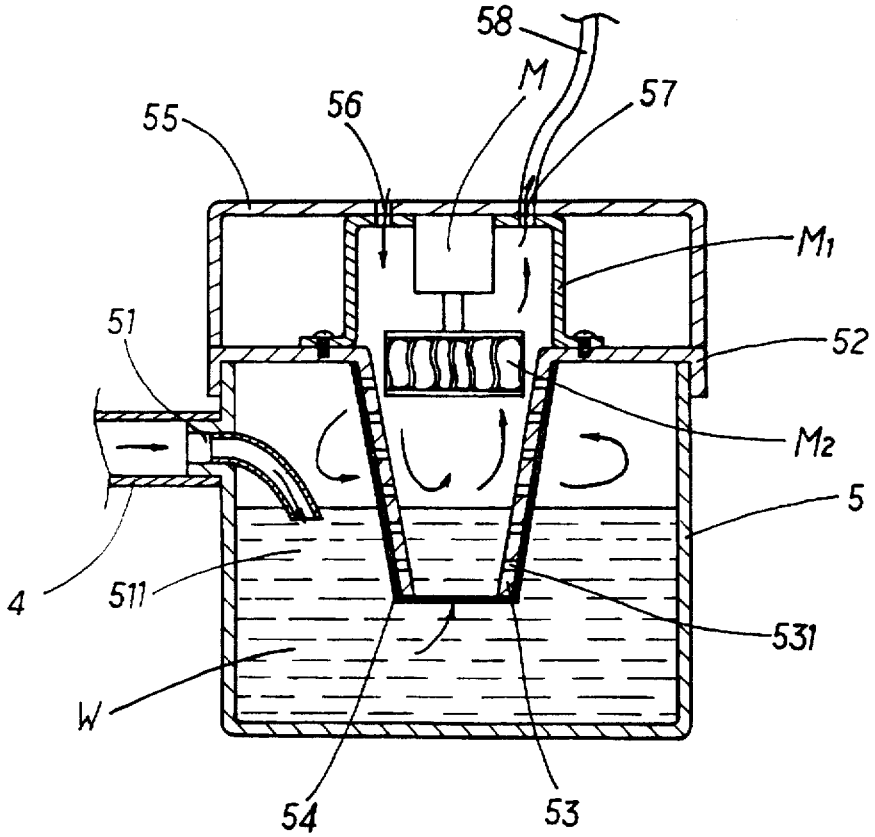
FIG. 5 is similar to FIG. 3 but showing the vane wheel turned, a turbulent flow of air induced.

Referring to FIGS. 4 and 5, when the user sits on the toilet seat 100, the stainless steel springs 3 are compressed, thereby causing the micro switch 2 to switch on the motor M. When the motor M is switched on, the vane wheel M2 is turned to draw outside air into the container 5 through the air inlet 56 and to expel inside air out of the container 5 through the air outlet 57 and the exhaust pipe 58, and at the same time the antiseptic solution W is stirred up to induce a vacuum suction force at the dip tube 51, causing filthy air to be sucked into the antiseptic solution W in the container 5 through the rigid air intake tube 1. When filthy air is drawn into the antiseptic solution W, it is deodorized and then carried out of the container 5 through the air outlet 57 and the exhaust pipe 58.

As indicated above, when one sits on the toilet seat 100 to empty one's bowels, the bad smell is immediately carried into the container 5 through the rigid air intake pipe 1 by a vacuum suction force and then treated by the antiseptic solution W. After treatment, odorless air is carried out of the container 5 through the air outlet 57 and the exhaust pipe 58. When the antiseptic solution W loses its effect, the container cover 52 can be opened from the container 5 to give a new supply of the antiseptic solution W. Further, because the air intake pipe 1 is a rigid pipe fixedly fastened to the bottom side of the toilet seat 100, it keeps the bottom side of the toilet seat 100 spaced from the top side of the toilet bowl 200 by a gap 300 (see FIG. 4). Because the center opening 400 of the toilet seat 100 is closed by the user's hip, bad smell is drawn through the gap 300 into the bevel inlets 11 of the rigid intake pipe 1.

While only one embodiment of the present invention has been shown and described, it will be understood that various modifications and changes could be made thereunto without departing from the spirit and scope of the invention disclosed.

What the invention claimed is:

1. A toilet deodorizing system comprising:

a rigid air intake pipe fixedly mounted on a bottom side of a toilet seat being hinged to a toilet bowl, said rigid air intake pipe having a plurality of bevel inlets spaced around a center opening of said toilet seat;

spring means fixedly mounted on the bottom side of said toilet seat, said spring means supporting said toilet seat on said toilet bowl when said toilet seat is closed on said toilet bowl;

a micro switch mounted on the bottom side of said toilet seat, said micro switch being switched off when said toilet seat receives no pressure, said micro switch being switched on when said toilet seat is closed on said toilet bowl and forced by the body pressure of a person to compress said spring means against said toilet bowl;

a container disposed outside said toilet bowl and holding an antiseptic solution and covered with a container cover, said container comprising a hole disposed at one side thereof connected to one end of said rigid air intake pipe by a hose, and a dip tube having one end connected to the hole of said container and an opposite end dipped in said antiseptic solution, said container cover comprising a downwardly disposed conical flange at the center, and a wire gauze filter covered on said conical flange, said conical flange having pores spaced around the periphery;

a shield covered on said container cover of said container, having a motor mounting frame on the inside fixedly secured to said container cover of said container, an air inlet through which outside air is drawn into said container, and an air outlet through which inside air is carried away from said container;

a motor fixedly mounted inside said motor mounting frame of said shield and connected to power supply through said micro switch; and a vane wheel coupled to said motor and suspending in said conical flange of said container cover;

wherein said motor is started to turn said vane wheel when a person sits on said toilet seat to switch on said micro switch, causing a suction force to be induced to draw foul air away from the inside of said bowl into said antiseptic solution in said container through said bevel inlets of said rigid air intake pipe and said hose and said dip tube for treatment, permitting inside air of said container to be carried away through said air outlet of said shield.

2. The toilet deodorizing system of claim 1, wherein said air outlet of said shield is connected to a toilet drain system by an exhaust pipe.

* * * * *